United States Patent [19]

Le Salver

[11] 4,074,525

[45] Feb. 21, 1978

[54] EXHAUST DEVICE FOR A COMBUSTION ENGINE

[75] Inventor: Robert Le Salver, Chanteloup Les Vignes, France

[73] Assignee: Automobiles Peugeot, Paris, France

[21] Appl. No.: 698,505

[22] Filed: June 22, 1976

[30] Foreign Application Priority Data

July 4, 1975 France ..... 75 21175

[51] Int. Cl.[2] ..... F01N 7/08

[52] U.S. Cl. ..... 60/322; 180/64 A

[58] Field of Search ..... 60/322, 323, 324; 180/64 A; 181/36 B

[56] References Cited

U.S. PATENT DOCUMENTS

| | | | |
|---|---|---|---|
| 2,227,306 | 12/1940 | Guy | 180/64 A |
| 2,242,604 | 5/1941 | Wells | 181/36 B |
| 2,370,559 | 2/1945 | Markey | 60/323 X |
| 2,451,285 | 10/1948 | Heath et al. | 181/36 B |
| 3,173,710 | 3/1965 | Kinnison | 180/64 A X |
| 3,459,444 | 8/1969 | Rofe | 180/64 A X |

FOREIGN PATENT DOCUMENTS

| | | | |
|---|---|---|---|
| 392,852 | 5/1933 | United Kingdom | 60/322 |

*Primary Examiner*—Carlton R. Croyle
*Assistant Examiner*—Michael Koczo, Jr.
*Attorney, Agent, or Firm*—Burns, Doane, Swecker & Mathis

[57] ABSTRACT

The exhaust pipe includes a flexible section adjacent its upstream end and is connected to the exhaust manifold. A support fixed to the part of the exhaust pipe immediately adjacent the flexible section is connected to the engine by a flexible connection.

5 Claims, 3 Drawing Figures

EXHAUST DEVICE FOR A COMBUSTION ENGINE

The present invention relates to a device for a flexible mounting of an exhaust pipe for the gases of a combustion engine. It more particularly applies to automobile vehicles.

Owing to their direct connection with the engine, exhaust pipes facilitate the transmission of vibrations to the body of the vehicles and of noise to the interior of the vehicle compartment, particularly when the engine is placed in the front of the vehicle since the exhaust pipe extends throughout the length of the vehicle.

This is why there has already been proposed the interposition of a flexible section in the exhaust line the upstream end of which remains rigidly fixed to the engine or to the exhaust manifold integral with the engine, whereas the part downstream of the flexible section is connected to the floor or the chassis by elastically yieldable means. Unfortunately, in such an arrangement, the flexible parts are subjected to complex deformations and forces which rapidly destroy them. This leads in certain cases to the adoption of very elaborate, and therefore costly, flexible parts which are associated with costly suspension devices so as to authorize deformations only in certain preferential directions.

An object of the invention is to provide a particularly simple and cheap solution to this problem and to ensure an effective filtering of the vibrations and noises transmitted by the exhaust line.

According to the invention, there is provided an exhaust device comprising an exhaust manifold carried by the engine and an exhaust pipe having a flexible section, wherein the flexible section is placed at the upstream end of the exhaust pipe and is connected to the manifold, and the part of the exhaust pipe placed immediately downstream of the flexible section is fixed to a support which is connected to the engine by a flexible connection.

Preferably, the exhaust pipe is rigidly connected to the support which extends roughly parallel to the flexible section of the exhaust pipe.

An embodiment of the invention will now be described with reference to the accompanying drawings in which.

Figure 1:
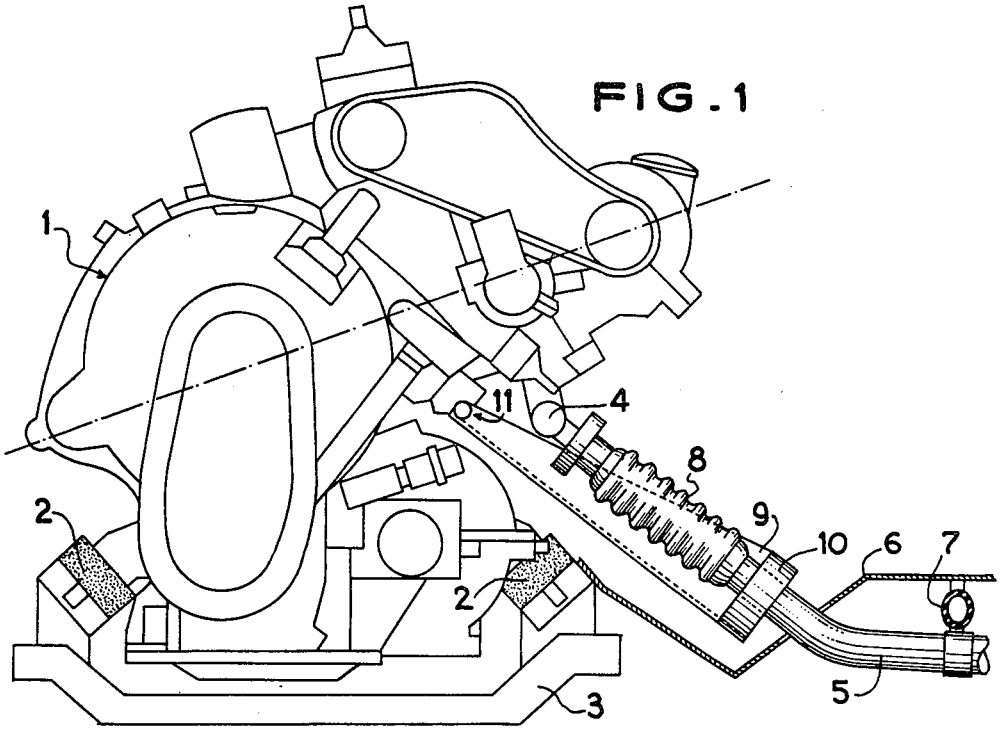
FIG. 1 is a side elevational view of the connection and mounting of an exhaust pipe line on an engine and a vehicle body.
Figure 2:
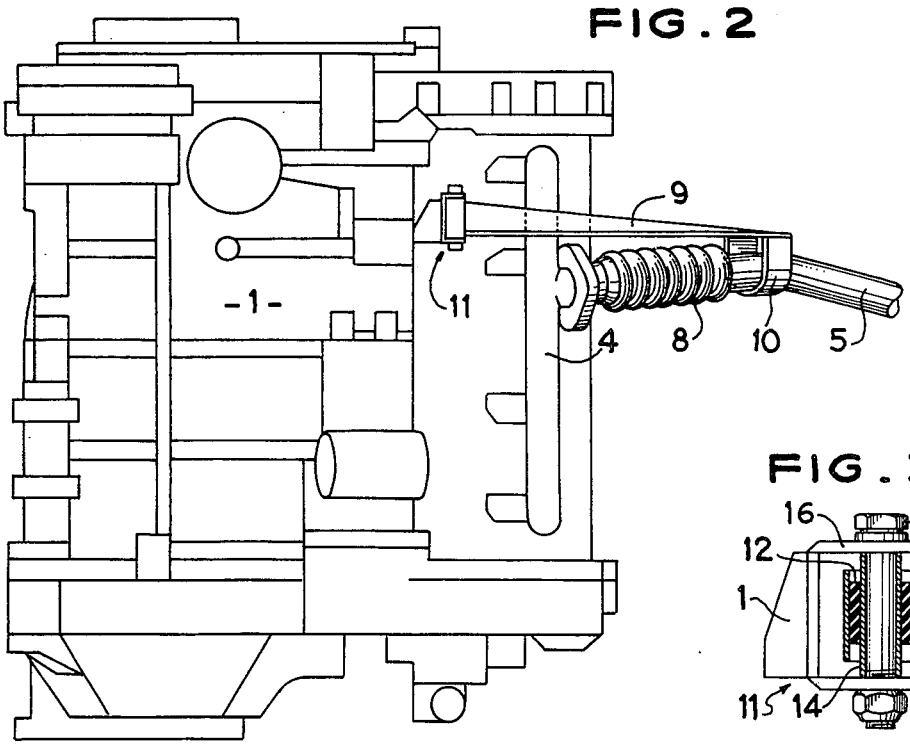
FIG. 2 is a corresponding plan view.
Figure 3:
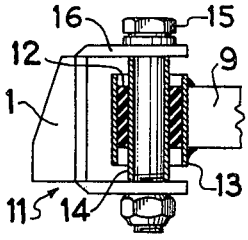
FIG. 3 is a sectional view, to an enlarged scale, of a detail of the structure shown in FIG. 2.

FIG. 1 shows a heat engine 1 which is fixed by elastically yieldable supports 2 to a cradle 3 of an automobile vehicle.

The exhaust gases are conducted by a manifold 4 and discharged to the rear of the vehicle by way of an exhaust pipe 5 which is fixed, in the usual manner, under the floor 6 by elastically yieldable supports 7.

Disposed between the manifold 4 and the exhaust pipe proper 5, is a flexible section 8 comprising, in the known manner, a metal wall having parallel corrugations which constitutes a bellows-like structure.

A support 9 directly interconnects the engine 1 and the part of the pipe 5 located immediately downstream of the section 8. This support comprises an arm extending in a direction roughly parallel to the flexible section 8. It is rigidly fixed by a collar 10 to the adjacent end portion of the pipe 5 and connected to the engine 1 through a flexible connection, such as an elastically yieldable pivotal connection 11. The connection 11, shown by way of example, comprises a sleeve 12 of elastomer bonded between an outer armature 13 rigid with the support 9 and an inner armature 14. The support 9 is held in position by a central bolt 15 extending through a fork member 16 rigid with the engine 1 and the inner armature 14.

Owing to the presence of the support 9, the flexible section 8 does not have to support the weight of the pipe 5 and undergoes deformations of only small amplitude. It is then possible to employ for the flexible section 8 simple and cheap manufacturing methods and yet the flexible section has a long life.

Moreover, the presence of the flexible section 8 and the elastically yeildable pivotal connection 11 ensures an excellent filtering of the vibrations and noise between the engine and the body.

This arrangement therefore solves the problem in a satisfactory manner with particularly simple means easily employed and therefore of a very reasonable cost. It will be understood that the form of the support and of the means connecting it to the exhaust pipe and the engine may be modified in many ways without departing from the scope of the invention.

Having now described my invention what I claim as new and desire to secure by Letters Patent is:

1. A gas exhaust device for and in combination with a combustion engine and a structure on which structure the engine is elastically mounted, said device comprising an exhaust manifold carried by the engine, an exhaust pipe which includes a flexible section and is connected to the manifold, the flexible section being disposed adjacent an upstream end of the exhaust pipe relative to the flow of exhaust gases through the pipe, a support independent of said structure, a part of the exhaust pipe located immediately downstream of the flexible section relative to said flow being connected to the support, and a flexible connection connecting the support to the engine.

2. A device as claimed in claim 1, wherein said part of the exhaust pipe immediately downstream of the flexible section is connected rigidly to the support which support extends in a direction substantially parallel to the flexible section.

3. A device as claimed in claim 1, wherein the support comprises an arm and a collar fixing the arm to said part of the exhaust pipe immediately downstream of the flexible section.

4. A device as claimed in claim 1, wherein the flexible connection comprises two armatures, a sleeve of elastomer bonded between the armatures, one of which armatures is connected to the support and the other of which armatures is connected to the engine.

5. A device as claimed in claim 1, wherein the flexible section is corrugated pipe constituting a structure.

* * * * *